United States Patent [19]

Silvestri, Jr.

[11] Patent Number: 4,827,429

[45] Date of Patent: May 2, 1989

[54] TURBINE IMPULSE CHAMBER TEMPERATURE DETERMINATION METHOD AND APPARATUS

[75] Inventor: George J. Silvestri, Jr., Winter Park, Fla.

[73] Assignee: Westinghouse Electric Corp., Pittsburgh, Pa.

[21] Appl. No.: 64,144

[22] Filed: Jun. 16, 1987

[51] Int. Cl.[4] ..... F01K 13/02

[52] U.S. Cl. ..... 364/494; 364/557; 60/667; 60/660

[58] Field of Search ..... 364/494, 557; 60/646, 60/660–667

[56] References Cited

U.S. PATENT DOCUMENTS 3,928,972 12/1975 Osborne ..... 60/660
3,928,977 12/1975 Braytenbah et al. ..... 60/660
4,297,848 11/1981 Silvestri, Jr. ..... 364/494
4,320,625 3/1982 Westphal et al. ..... 60/646
4,425,762 1/1984 Wakamatsu et al. ..... 60/646
4,549,503 10/1985 Keyes, IV et al. ..... 60/667

*Primary Examiner*—Parshotam S. Lall
*Assistant Examiner*—V. N. Trans

[57] ABSTRACT

A method and apparatus for determining the steam temperature in the impulse chamber at the first stage exit of a multistage high pressure steam turbine utilizes measurement of steam pressure in the impulse chamber and steam pressure and temperature at the exhaust as inputs to a digital computer. The functional relationships among steam pressure, temperature, specific volume, enthalpy and entropy are stored in the computer memory, and used with these measured quantities to iteratively calculate the steam temperature at the impulse chamber.

5 Claims, 3 Drawing Sheets

TURBINE IMPULSE CHAMBER TEMPERATURE DETERMINATION METHOD AND APPARATUS

BACKGROUND OF THE INVENTION

1. Field of the Invention

The present invention relates to high pressure steam turbines, and more particularly to a method for determining the first stage exit or impulse chamber temperature in high pressure steam turbines.

2. Description of the Prior Art

In the operation of multistage high pressure steam turbines, the rotor surface temperature closely follows the steam temperature while the interior rotor and bore responds more slowly, inducing thermal stresses. This results in low cycle thermal fatigue. Thus, the value of the steam temperature at the first stage exit is needed to permit control under widely varying load, as at startup, to minimize such stresses.

Typically, on starting, the turbine is brought up to speed, the generator synchronized, and a load of 5% applied with full-arc admission operation. As the load is increased, a transfer is made from full-arc admission to partial arc admission. This results in a step change in the first stage steam exit temperature. Such change may be 70° F. for a minimum admission arc of 50%, and 100° F. for a 25% minimum admission arc.

In this procedure the abrupt changes in steam temperature increase such thermal stresses.

Attempts have been made to minimize thermal stresses; for example, by a gradual transfer. In this approach, the valves corresponding to minimum admission are opened and the remaining valves closed. The rate of change of the first stage steam temperature is controlled by adjusting the rate of valve movement. This method therefore depends on an accurate measurement of the steam temperature. Commonly, a thermocouple is installed in the shell wall or other location at the impulse chamber for establishing the steam temperature.

However, the thermocouple measures the metal temperature rather than the steam temperature during changing conditions due to the inherent slow time of response. The metal temperature will be lower than the steam temperature, particularly during transients.

It is difficult to accurately measure the first stage steam temperature because of the high pressure, thicknesses of the metal shells, and slow response of the thermocouples. In the past, thermocouples for this purpose have been embedded in the shell or the base of the stationary blade of the next stage. However, the metal temperature is actually measured rather than the steam, The use of a well protruding into the steam path could give a more accurate measurement but presents a risk of breaking off and being carried into the flow path.

Turbines also experience temperature variations, which are of special concern at the first stage exit, during load changes because of the inherent mass flow-temperature characteristics of both the boiler and the turbine. Prompt detection of these temperature changes results in optimum rates of load change with improved turbine life.

SUMMARY OF THE INVENTION

The present invention is a method for accurately determining the first stage steam temperature by calculation from other accurately measured system parameters. The parameters required are: the high pressure (HP) exhaust steam pressure, the HP exhaust steam temperature, and the impulse chamber pressure. The overall blading efficiency between the impulse chamber and the HP exhaust is also utilized in the calculation.

To measure the HP exhaust temperature, a calibrated thermocouple of a fast response design is installed in the HP exhaust pipe. The HP exhaust pressure and the impulse pressure are measured with pressure transducers. Analog signals from these devices are converted to digital signals and utilized by a digital computer to apply algorithms which relate the first stage temperature to these parameters by an iterative process. The computer is programmed to include the properties of steam.

The enthalpy h, the specific volume v, and the entropy S are each expressed as a function of pressure and temperature; the entropy as a function of pressure and enthalpy, and the enthalpy as a function of pressure and entropy. These functions are readily derived from steam tables.

As may now be understood, the principal object of the invention is to provide a method for determining the steam temperature at a point in a turbine system for which accurate and rapid response direct measurement is not practical from measurements at points of pressure and temperature which can be accurately measured.

DETAILED DESCRIPTION OF THE EMBODIMENT

Figure 1:
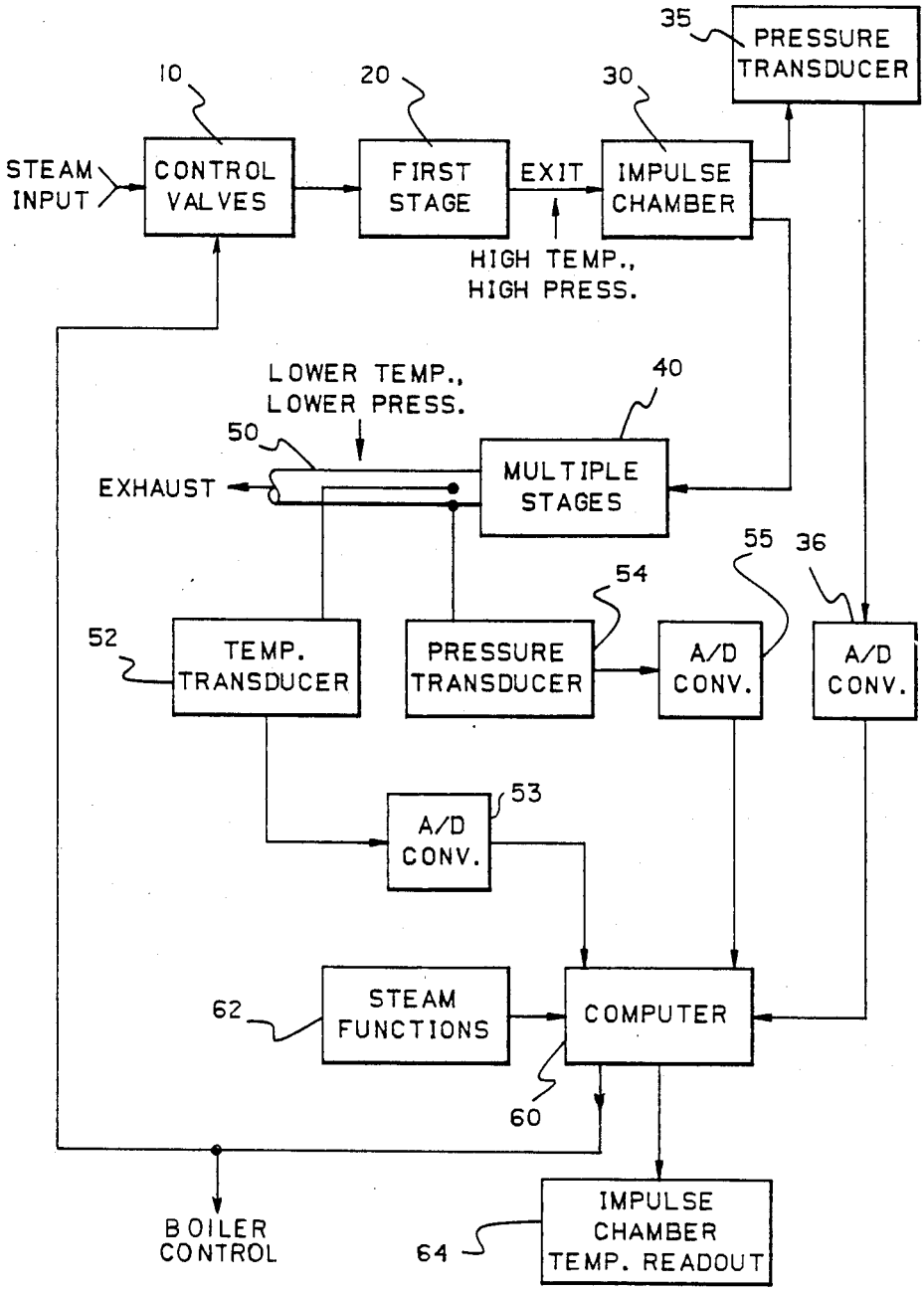
FIG. 1 is a simplified block diagram of a multistage high pressure steam turbine having the apparatus of the invention connected thereto.

The present invention concerns a method and apparatus for determining the steam temperature at the first stage exit (impulse chamber) in a multi-stage high pressure steam turbine. FIG. 1 shows a greatly simplified block diagram of a typical turbine system instrumented in accordance with the invention.

Steam is input to the first stage 20 via control valves 10. The steam at the exit is at a high temperature and high pressure. As previously discussed, direct measurement of the temperature is difficult, especially during load changes. The impulse chamber 30 at the first stage exit is instrumented with transducer 35 to obtain the steam pressure therein.

As the steam passes through multiple stages 40 and exhausts via exhaust 50, the steam temperature and pressure drop such that these parameters are lower at exhaust 50. In accordance with the invention, a pressure transducer 54 and a temperature transducer 52 are installed to measure these exhaust steam parameters.

A computer 60 is programmed with appropriate steam properties functions 62 and algorithms to calculate the impulse chamber 30 temperature which is presented on readout 64. The blading efficiency of the turbine system is also stored in computer 60.

The exhaust temperature transducer 52 may be a thermocouple having fast response and installed in the HP exhaust pipe. Electrical signals from transducers 35, 52 and 54 are converted to digital signals by A/D converters 36, 53 and 55, respectively.

The steam properties function of steam tables 62 required are:

h, v and S=f(P,T)

T, v and S=f(P,h)

v, h and T =f(P,S)

where h=enthalpy (Btu/lb)

v=specific volume ($ft^3$/lb)

S=entropy (Btu/lb/$^0$F)

P=pressure (psia)

T=temperature (°F.)

The steam properties functions are generally available in engineering computer libraries. However, simplified estimating procedures have been developed as discussed below.

Figure 2:
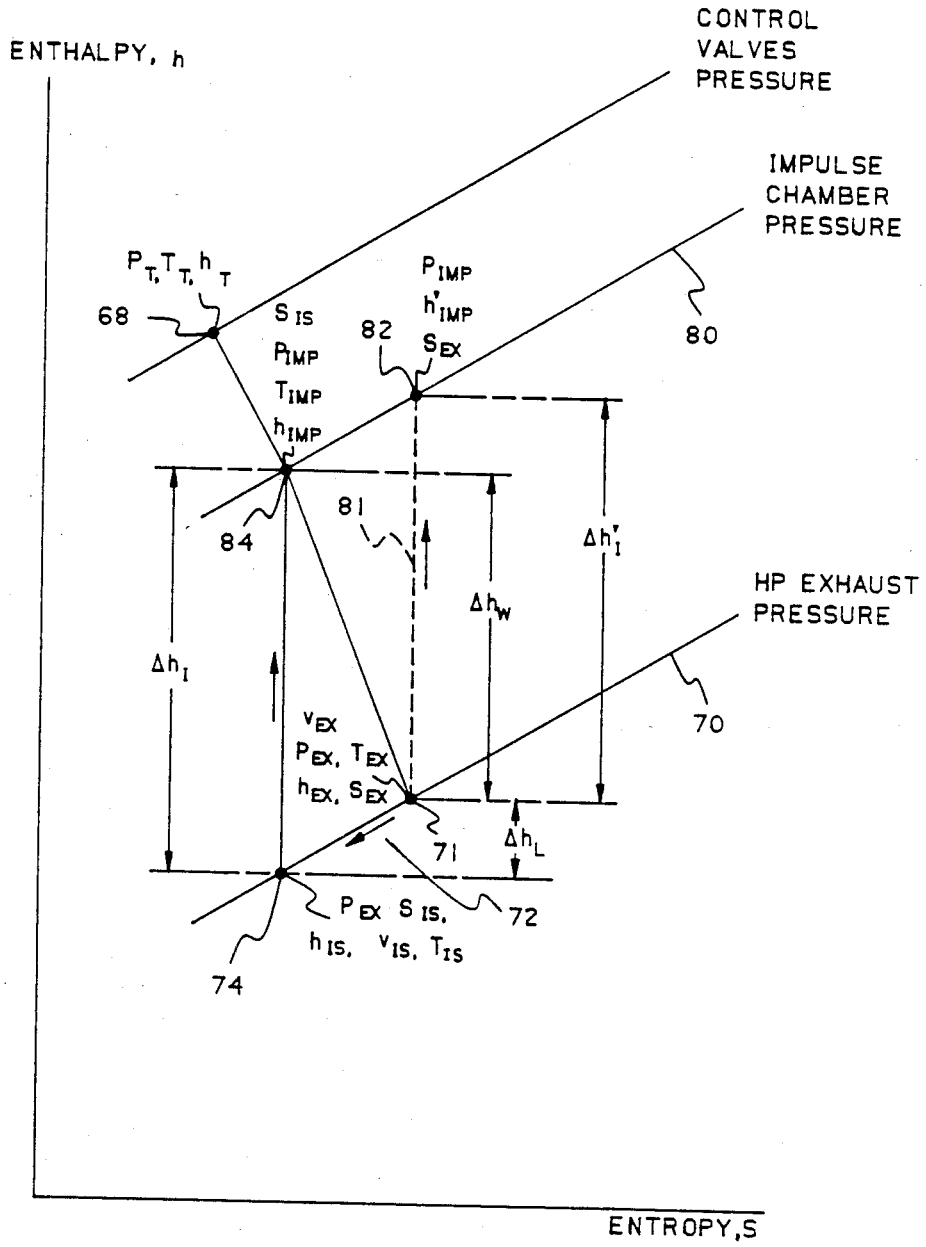
FIG. 2 is an enthalpy-entropy diagram for the system of FIG. 1 for illustrating the method of the invention for determining steam temperature in the impulse chamber.

The method of determining the impulse chamber temperature will be described with reference to FIG. 2 which presents enthalpy h as a function of entropy S and pressure P. The measured value of impulse chamber pressure $P_{IMP}$ is shown as constant pressure line 80, and the measured value of exhaust pressure $P_{EX}$ is shown as constant pressure line 70. Although the impulse chamber pressure line 80 and the exhaust pressure line 70 appear in FIG. 2 to be parallel, it is to be understood that the two lines diverge slightly such that the Δh difference between the impulse chamber and the exhaust is not constant.

In addition to the steam properties functions, the blade efficiency is required to be stored in the computer. The blade group losses, $\Delta h_L$ plus the enthalpy change $\Delta h_W$ in operation of the turbine are used to determine the isentropic enthalpy change $\Delta h_I$ as may be noted from FIG. 2. Thus, the blade efficiency can be defined as $$\eta = \Delta h_W / \Delta h_I$$

and $$\Delta h_L = (\Delta h_I)(1-\eta)$$

Therefore, $$h_{IS} = h_{EX} - \Delta h_L$$

A trial point 71 for $P_{EX}$ is to be selected. From the steam properties functions h=f(P,T) and S=f(P,h) and using the measured quantities $P_{EX}$ and $T_{EX}$, $h_{EX}$ and $S_{EX}$ are calculated to define trial point 71. Impulse chamber temperature $T_{IMP}$ is not known and $\Delta h_I$ cannot be directly calculated. Therefore, an iterative process is used. Point 82 along constant entropy line 81 is selected on impulse chamber pressure line 80. At this point $h'_{IMP}$ is calculated to determine trial value $\Delta h'_I$.

Next, an estimated value of blade group loss $\Delta h_L$ is calculated from the relation $\Delta h_L = (\Delta h'_I)(1-\eta)$. This permits a new trial point 74 on the exhaust pressure line to be determined thereby defining a new trial value of impulse chamber entropy $S_{IS}$ and $\Delta h_I$ calculated from $P_{EX}$, hIS and PIMP. Thus, point 84 is defined permitting calculation of $T_{IMP}$. $\Delta h_I$ will differ from $\Delta h'_I$ permitting calculation of a new $\Delta h_L$. If this $\Delta h_L$ is within a selected tolerance, then point 84 is accepted. However, if not, the process is repeated until the value of $\Delta h_I$ varies by less than the selected tolerance. For example, a value of 0.1 Btu/lb has been determined to be an acceptable tolerance without requiring excessive iteration. As will be noted, the loss in enthalpy and entropy through the first stage 20 from the control valve input parameters at point 68 can be determined.

As will now be recognized, a method of determining impulse chamber temperature with a high degree of accuracy has been disclosed from measurements of impulse chamber pressure, HP exhaust pressure, and HP exhaust temperature. The method disclosed utilizes a computer programmed with the steam properties functions. If a microprocessor or microcomputer is to be used or the steam properties programs are not available, emperical correlations have been developed.

For the cases in which either h=f(P,T) or T=f(P,h) are required, the same functional form has been used for each. The function is of the form:

$$Z = A1 + A2Y + A3Y^2 + A4Y^3 + A5X + A6X^2 + A7X^3 + A8X^4 + Y(A9X + A10X^2 + A11X^3 + A12X^4) + Y^2(A13X + A14X^2 + A15X^3 + A16X^4) + Y^3(A17X + A18X^2 + A19X^3 + A20X^4)$$

where, for $h = f(P,T)$:

$$Z = h(\text{Btu/lb}) \quad (1)$$

$$X = (T + 460)/100$$

$$Y = \ln P$$

$T$ = Temperature, °F.

$P$ = Pressure (psia), and where, for $T = f(P,h)$:

$$Z = (T + 460)/100 \quad (2)$$

$$X = h/100$$

$$Y = \ln P$$

Four curve fits are required, two for h=f(P,T) and two for T=f(P,h). Both the h=f(P,T) and T=f(P,h) correlations are broken into two ranges.

For h=f(P,T), equation (1), the first curve fit, covers the range up to 300 psia and the other curve fit covers the range from 300 psia to 1500 psia. This functional relationship is required at the HP exhaust state point only. The error is less than 0.2 Btu/lb over the temperture range between 20° F. superheat and 800° F. at pressures up to 300 psia. For pressures between 300 psia and 800 psia the error is less than 0.6 Btu/lb for the temperature range between 30° F. superheat and 900° F. For pressure between 800 psia and 1500 psia the maximum error is 1.4 Btu/lb at 30° F. superheat with the average error being 0.2 to 0.3 Btu/lb for temperatures up to 900° F. This functional relationship is also used at the HP exhaust state point only.

For T=f(P,h), the first curve fit, equation (2) covers the pressure range up to 300 psia while the other curve fit covers the range between 300 and 2500 psia. This relationship is used to calculate the impulse chamber temperature. The maximum error is 0.6° F. in the temperature rang between 30° F. superheat and 930° F. at pressures up to 300 psia. For pressures between 300 and 2500 psia, the maximum error is 1.0° F. in the temperature range between 30° F. superheat and 1050° F. The root mean square error is 0.27° F.

The constants A1 through A20 for the equations are given in Table I:

| TERM | T = f (P,h) P ≦ 300 psia | T = f (P,h) P > 300 psia P ≦ 2500 psia | h = f (P,T) P ≦ 300 psia | h = f (P,T) P > 300 psia P ≦ 1500 psia |
|---|---|---|---|---|
| A1 | = −1.7397102E+04 | −2.1242258e+04 | 1.3826214E+03 | 4.9253404E+04 |
| A2 | = 1.4358832E+04 | 1.8483831E+04 | 1.5666764E+03 | −3.2163915E+04 |
| A3 | = 3.3878966E+03 | −7.3309070E+03 | −7.0264608E+02 | 7.3107331E+03 |
| A4 | = 4.7867517E+02 | 7.8289790E+02 | 6.3098757E+01 | −5.6767978E+02 |
| A5 | = 4.7685944E+03 | −1.9820058E+03 | −1.4515763E+03 | −1.7349504E+03 |
| A6 | = −5.2890903E+02 | 1.1906983E+03 | 4.2616230E+02 | −5.5810531E+02 |
| A7 | = 2.8878807E+01 | −1.0717003E+02 | −4.0710642E+01 | 3.6390647E+01 |
| A8 | = −6.2207856E−01 | 2.8685077E+00 | 1.2765043E+00 | −3.4514401E−01 |
| A9 | = −3.9108743E+03 | −2.0044221E+03 | 1.6132909E+02 | 2.5931430E+03 |
| A10 | = 4.1665148E+02 | −2.0649346E+02 | −1.5347909E+02 | 1.7801823E+02 |
| A11 | = −2.0706509E+01 | 3.2938974E+01 | 1.8336194E+01 | −1.8312715E+01 |
| A12 | = 4.0752201E−01 | −1.0397524E+00 | −6.3292607E+01 | 2.8222941E−01 |
| A13 | = 8.2873800E+02 | 1.7232396E+03 | 1.2921812E+02 | −9.0762542E+02 |
| A14 | = 7.7943256E+01 | −1.3289305E+02 | 7.2233323E+00 | 9.2482668E+00 |
| A15 | = 3.3995237E+00 | 3.3035183E+00 | −2.2089285E+00 | 1.9484602E+00 |
| A16 | = −5.9658865E−02 | 2.9083615E−09 | 9.3499351E−02 | −4.4081285E−02 |
| A17 | = −1.1578929E+02 | −2.1167198E+02 | −1.6865653E+01 | 9.3417570E+01 |
| A18 | = 1.0512825E+01 | 2.0819228E+01 | 8.5012493E−01 | −4.6273416E+00 |
| A19 | = −4.2652784E−01 | −8.7245053E−01 | 5.8607307E−02 | 5.5214539E−02 |
| A20 | = 6.6242179E−03 | 1.2991847E−02 | −4.1144032E−03 | 2.8475805E−04 |

From analyses, it is found that $\Delta h'_I$ and $\Delta h_I$ can be calculated very accurately as a function of the pressure ratio PR, which equals $P_{IMP}$ divided by $P_{EX}$. For pressure ratios in the range of 2.5 to 7.0 the value of $\Delta h$ differs from the actual value (ASME Steam Tables) by less than 0.05 Btu/lb for values of $\Delta h$ between 100 Btu/lb and 260 Btu/lb. This correlation is done at a pressure volume product, Pv, of 580.3. For other values of Pv, the values of $\Delta h_I$ is multipled by the ratio of the actual Pv product and 580.3. Equation (3) is as follows:

$$\Delta h_I = (-81.4056465 + 107.93291\ PR - 16.141899\ PR^2 + 1.51341879\ PR^3 - 0.0593706288\ PR^4)Pv/580.3 \quad (3)$$

Rather than developing a surface fit to calculate specific volume v, in order to determine Pv, use is made of the fact that Pv in the superheated region is a very weak pressure function and has strong enthalpy dependence. The enthalpy dependence is fairly linear. The effect is similar to perfect gas behavior where Pv=f(T). For vapors like steam, Pv=f(h) is an equivalent relationship in the superheated region.

The Pv vs h function may be determined at pressures of 1 psia, 500 psia, 1000 psia, 2000 psia, and 3000 psia and linear interpolation used between pressures. The generic form of the equation is:

$$Pv = A1 + A2h + A3h^2 + A4h^3 + A5h^4 \quad (4)$$

The constants corresponding to the various pressures are listed in Table II:

| TERM | PRESSURE, PSIA 1.0 | 500. | 1000 | 2000. | 3000. |
|---|---|---|---|---|---|
| A1 | −1.13938219E+03 | 2.95496778E+03 | 3.73437906E+03 | 3,74738427E+03 | 3,50170328E+03 |
| A2 | 9.99280174E−01 | −9.51191963E+00 | −1.14745113E+01 | −1.14165189E+01 | −1.06576249E+01 |
| A3 | 6.96985380E−04 | 1.07288988E−02 | 1.25408069E−02 | 1.23537275E−02 | 1.14908003E−02 |
| A4 | −4.49816311E−07 | −4.67668760E−06 | −5.40840716E−06 | −5.26235460E−06 | −4.83649641E−06 |
| A5 | 8.28145545E−11 | 7.47099990E−10 | 8.56660484E−10 | 8.22118157E−10 | 7.45266979E−10 |

At 1 psia the maximum error is about 1 part in 1000 in the temperature range from 50° F. superheat to 1500° F. At 500 psia the maximum error is about 1.5 parts in 1000 between the saturation temperature and 1500° F. At 1000 psia the maximum error is about 0.3 parts in 1000 between the saturation temperature and 1500° F. At 2000 psia the maximum error is about 2 parts in 1000 from 15° F. superheat to 1500° F. At 3000 psia the maximum error is about 1 part in 1000 from 15° F. superheat to 1500° F.

Restating the procedure, $h_{EX}$ is calculated from $P_{EX}$ and $T_{EX}$ using the emperical correlation, equation (1). At $P_{EX}$ and $h_{EX}$, Pv is calculated from equation (4). From Pv and the pressure ratio, $\Delta h'_I$ is calculated from equation (3). Then from $\Delta h'_I$ and $\gamma$), an estimate of $\Delta h_L$ is calculated. An estimate of $h_{IS}$ is calculated from $h_{EX}$ and $\Delta h_L$ ($h_{IS}=h_{EX}-\Delta h_L$). At $P_{EX}$ and $h_{IS}$ a new value of Pv is calculated which is used along with the pressure ratio to calculate $\Delta h_I$ and $h_{IS}$ which are then used to recalculate Pv and $\Delta h_I$. When the change in successive values of $\Delta h_I$ is less than 0.1 Btu/lb, convergence is achieved. With the converged value of $\Delta h_I$ and $h_{IS}$, $h_{IMP}$ ($h_{IMP}=h_{IS}+\Delta h_I$) is calculated. From $P_{IMP}$ and $h_{IMP}$, $T_{IMP}$ is calculated from equation (2).

After calculation of the impulse chamber temperature using the steam properties functions or the emperical correlations described above, the value may be displayed on a suitable readout 64 as shown in FIG. 1. The value of $T_{IMP}$ at any time is available as a digital signal and may be used in automatic control systems to minimize step or rapid changes in temperature and therefore low cycle thermal fatigue.

Figure 3:
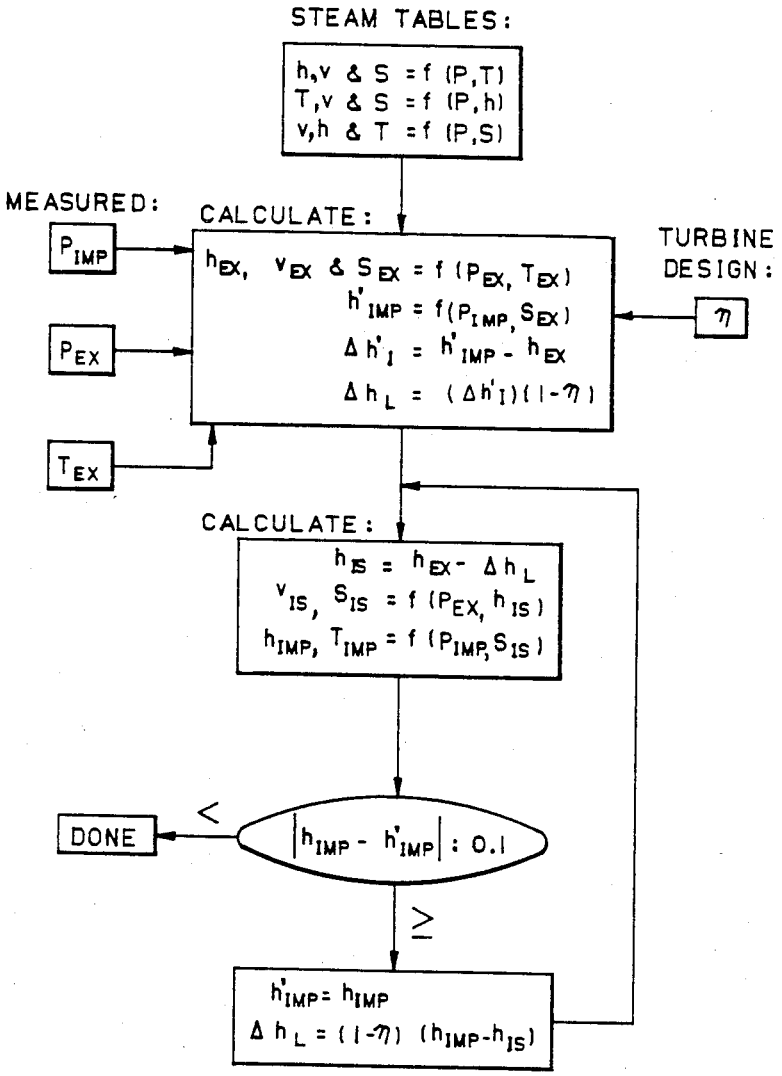
FIG. 3 is a flow diagram for the method of the invention.

A flow chart of the method of the invention is shown in FIG. 3. As may be noted, the following steps are involved in determination of the impulse chamber temperature of a multistage high pressure steam turbine.

1. Provide steam tables defining:

(a) enthalpy h, specific volume v, and entropy S as functions of pressure P and temperature T;

(b) T, v, and S as functions of P and h; and
(c) v, h, and T as functions of P and S;
2. Measure:
(a) exhaust steam pressure $P_{EX}$;
(b) exhaust steam temperature $T_{EX}$;
(c) impulse chamber pressure $P_{IMP}$;
3. Provide a measure of blade group efficiency;
4. Calculate the exhaust enthalpy $h_{EX}$, the exhaust specific volume $v_{ex}$, and the exhaust entropy $S_{EX}$ using the steam tables, and $P_{EX}$ and $T_{EX}$ measurements;
5. Calculate a trial value of the impulse chamber enthalpy $h'_{IMP}$ using the steam tables and the calculated value of $h_{EX}$;
6. Calculate a trial value of the change in sentropic enthalpy $\Delta h'_I$ from the values of $h_{EX}$ and $h'_{IMP}$;
7. Initialize $\Delta h_I$ equal to $\Delta h'_I$;
8. Calculate a trial value $\Delta h_L$ of the portion of $\Delta h_I$ due to blade group losses using efficiency factor $\eta$;
9. Calculate an iterative value of exhaust isentropic enthalpy $h_{IS}$ by subtracting $\Delta h_L$ from $h_{EX}$;
10. Calculate new values of $v_{EX}$ and $S_{IS}$ using the steam tables and $h_{IS}$;
11. Calculate trial values of $h_{IMP}$, $T_{IMP}$, and $\Delta h_I$ using $P_{IMP}$, $h_{IS}$, $S_{IS}$ and the steam tables;
12. Repeat steps 8–10 until successive values of $\Delta h_I$ are less than a preselected tolerance.

Although specific examples of the method and apparatus have been shown in the disclosure, the invention is suitable for other applications and various modifications may be made without departing from the spirit and scope of the invention.

I claim:

1. In a multistage high pressure steam turbine having a first stage and an exhaust, a method for controlling turbine loading to effect a controlled rate of change in the steam temperature at an impulse chamber at the exit of the first stage thereof comprising the steps of:

(a) measuring the steam pressure $P_{EX}$ at said exhaust;
(b) measuring the steam temperature $T_{EX}$ at said exhaust;
(c) measuring the steam pressure $P_{IMP}$ at said first stage exit;
(d) determining and providing a measure of blade group efficiency;
(e) providing tables defining the enthalpy h, the specific volume v, and the entropy S of steam as functions of pressure P and temperature T, defining T, v, and S as functions of P and h, and defining v, h, and T as functions of P and S;
(f) calculating the enthalpy $h_{EX}$, the specific volume $V_{EX}$, and the entropy $S_{EX}$ from said tables at said exhaust;
(g) calculating a first trial value of the enthalpy $h_{IMP}$ at said impulse chamber using said tables and the calculated value of $h_{EX}$;
(h) calculating a first trial value of the change in isentropic enthalpy $\Delta h'_I$ from the calculated values of $h_{EX}$ and $h'_{IMP}$;
(i) calculating a first trial value of blade group losses $\Delta h_L$ from $\Delta h'_I$ using the efficiency factor $\gamma$;
(j) calculating a first iterative value of isentropic enthalpy $h_{IS}$ at the exhaust by subtracting $\Delta h_L$ from $h_{EX}$;
(k) calculating second trial values of $v_{EX}$ and $s_{IS}$ from the tables and $h_{IS}$;
(l) calculating second trial values of $h_{IMP}$, $T_{IMP}$ and $\Delta h_I$ using $P_{IMP}$, $h_{IS}$, $S_{EX}$ and the tables;
(m) repeating steps h–j until a successive value of $\Delta h_I$ is less than a preselected tolerance; and
(n) controlling steam flow into the first turbine stage so as to effect a contolled change in $T_{IMP}$ with variations in turbine loading.

2. The method as defined in claim 1 which further comprises the steps of:

storing said tables and said blade group efficiency $\eta$ in a digital computer memory;
digitizing said $P_{EX}$, $T_{EX}$, and $P_{IMP}$; and
providing a digital computer for performing said calculation steps.

3. In a multistage high pressure steam turbine having a first stage and a steam exhaust, a system for determining the steam temperature at an impulse chamber at the exit of the first stage thereof comprising:

(a) a first pressure transducer disposed in said impulse chamber for producing a first electrical signal proportional to steam pressure therein;
(b) a second pressure transducer disposed in said steam exhaust for producing a second electrical signal proportional to steam pressure therein;
(c) a fast response temperature transducer disposed in said steam exhaust for producing a third electrical signal proportional to steam temperature therein;
(d) a digital computer having memory means and readout means;
(e) a table of steam functions stored in said memory means, said table including the enthalpy, the specific volume and the entropy of steam as functions of pressure and temperature, the temperature, specific volume, and entropy of steam as functions of pressure and enthalpy, and specific volume, enthalpy, and temperature of steam as functions of pressure and entropy;
(f) a group blade efficiency measure for said turbine stored in said memory means; and
(g) analog to digital converter means connected to said first and second pressure transducers, and to said temperature transducer for converting said first, second and third electrical signals therefrom to first, second and third digital electrical signals, outputs of said converter means connected to said digital computer, said digital computer is programmed to iteratively calculate the steam temperature at said impulse chamber from said first, second and third digital electrical signals using said table of steam functions and said efficiency measure.

4. The system as defined in claim 3 in which said computer readout means displays said impulse chamber steam temperature.

5. Apparatus for determining steam temperature in an impulse chamber at the first stage exit, of a multistage high pressure steam turbine comprising:

first steam pressure measuring means for producing a first digital electrical signal representative of the steam pressure in said impulse chamber;
second steam pressure measuring means for producing a second digital electrical signal representative of the steam pressure at a steam exhaust of said turbine;
first steam temperature measuring means for producing a third digital electrical signal representative of the steam temperature at said steam exhaust of said turbine;
a digital computer having said first, second, and third measuring means connected thereto, said digital computer including memory means for storing a table of steam functions, said table defining the enthalpy, specific volume, and entropy of steam as functions of pressure and temperature, defining specific volume and entropy of steam as functions of pressure and enthalpy, and defining specific volume, enthalpy and temperature of steam as functions of pressure, and entropy;

said memory means storing a measure of turbine group blade efficiency; and said digital computer programmed to iteratively calculate the steam temperature at said impulse temperature from said first, second and third digital electrical signals using said table of steam functions and said turbine group blade efficiency.

* * * * *